US010781021B2

(12) United States Patent
Martinson

(10) Patent No.: US 10,781,021 B2
(45) Date of Patent: Sep. 22, 2020

(54) SYSTEMS AND METHODS FOR A CORD HOLDER

(71) Applicant: Nite Ize, Inc., Boulder, CO (US)

(72) Inventor: Daniel J. Martinson, Medina, MN (US)

(73) Assignee: NITE IZE, INC., Boulder, CO (US)

( * ) Notice: Subject to any disclaimer, the term of this patent is extended or adjusted under 35 U.S.C. 154(b) by 358 days.

(21) Appl. No.: 15/398,570

(22) Filed: Jan. 4, 2017

(65) Prior Publication Data

US 2017/0190486 A1 Jul. 6, 2017

Related U.S. Application Data

(60) Provisional application No. 62/274,650, filed on Jan. 4, 2016.

(51) Int. Cl.
*B65D 63/10* (2006.01)
*B65B 13/02* (2006.01)
*B65D 63/12* (2006.01)

(52) U.S. Cl.
CPC ..... *B65D 63/109* (2013.01); *B65B 13/02* (2013.01); *B65D 63/12* (2013.01)

(58) Field of Classification Search
CPC ..... B65B 13/02; B65D 63/109; B65D 63/00; B65D 63/02; B65D 63/10; B65D 63/12; B65D 63/1018; B65D 63/1027; B29L 2031/727; B29L 2031/7276; Y10T 24/1498
USPC ..... 100/31, 33 PB; 24/16 R, 16 PB, 17 AP, 24/27, 30.5 P, 30.5 S; 206/702; 248/52
See application file for complete search history.

(56) References Cited

U.S. PATENT DOCUMENTS 3,603,551 A * 9/1971 Peterson ..... A47F 7/0028 211/70.6
4,914,789 A * 4/1990 Pedersen ..... B65D 33/1625 24/30.5 S
5,042,113 A * 8/1991 Severson ..... H01R 13/6392 24/16 PB
5,692,268 A 12/1997 Case
6,161,263 A * 12/2000 Anderson ..... A41B 11/002 24/30.5 S
8,806,723 B2 8/2014 Martinson et al.
(Continued)

FOREIGN PATENT DOCUMENTS

CN 202728880 U 2/2013
CN 103842711 A 6/2014
(Continued)

OTHER PUBLICATIONS

Mar. 10, 2017 PCT Search Report and Written Opinion issued as to PCT/US2017/012191.
(Continued)

*Primary Examiner* — Jimmy T Nguyen
(74) *Attorney, Agent, or Firm* — Haynes and Boone, LLP

(57) ABSTRACT

An apparatus for securing items includes a twist tie and a stretchable end for the twist tie, the stretchable end molded around the twist tie. The stretchable end includes an aperture, a narrow slit in the stretchable end. In one configuration, the aperture may stretch wider and longer than a starting shape. The stretchable end is made of Thermoplastic Elastomer (TPE) and has a durometer between 30 and 100 shore A.

20 Claims, 3 Drawing Sheets

(56) References Cited

U.S. PATENT DOCUMENTS

| | | | |
|---|---|---|---|
| 2006/0012199 | A1 | 1/2006 | Slank |
| 2006/0075610 | A1 | 4/2006 | Buchanan |
| 2009/0106948 | A1 | 4/2009 | Lopez et al. |
| 2015/0225150 | A1 | 8/2015 | Farrell |

FOREIGN PATENT DOCUMENTS

| | | | |
|---|---|---|---|
| CN | 203632138 | U | 6/2014 |
| JP | 2002-264965 | A | 9/2002 |
| WO | WO 201 3/01 921 | | 2/2013 |
| WO | WO 2014/123282 | A1 | 8/2014 |
| WO | WO 2014/152590 | A1 | 9/2014 |

OTHER PUBLICATIONS

European Search Report dated Apr. 11, 2019 issued in related European Patent App. No. 17736262.1 (7 pages).
Chinese Office Action with search report dated Mar. 4, 2019 issued in related Chinese Patent App. No. 201780005132.5 (16 pages with English translation).
Office Action dated Nov. 15, 2019 issued in related Canadian patent application No. 3002866 (4 pages).
Office Action dated Nov. 29, 2019 issued in related Japanese patent application No. 2018-534929 (13 pages with English translation).
Office Action dated Nov. 26, 2019 issued in related Chinese patent application No. 201780005132.5 (13 pages with English translation).

* cited by examiner

SYSTEMS AND METHODS FOR A CORD HOLDER

CROSS REFERENCE TO RELATED APPLICATION

This application claims the benefit of U.S. Provisional Patent Application No. 62/274,650 filed Jan. 4, 2016, and hereby incorporated by reference to the same extent as though fully disclosed herein.

BACKGROUND

Twist ties may be used to secure and hold a variety of objects. It is desirable for users to mount twist ties, especially those with high-end performance characteristics, in a variety of temporary and more permanent configurations, so that objects may be secured in useful positions.

SUMMARY

In one embodiment, an apparatus for securing items includes a twist tie; and a stretchable end for the twist tie, the stretchable end molded around the twist tie. Optionally, the stretchable end includes an aperture. Alternatively, the aperture is a narrow slit in the stretchable end. In one configuration, the aperture may stretch wider and longer than a starting shape. Optionally, the stretchable end is made of Thermoplastic Elastomer (TPE) and has a durometer between 30 and 100 shore A. In one alternative, the stretchable end is overmolded on the twist tie. In another alternative, the stretchable end is designed to hold an object, and the aperture of the stretchable end is sized such that, to hold the object, the stretchable end stretches and, therefore, frictionally holds the object. Alternatively, the twist tie further includes an elongated piece of shape-retaining deformable material, a cover covering the shape-retaining deformable material along a length of the elongated piece, the cover and the shape-retaining deformable material being bonded along their length; and an outer cover covering the cover, the outer cover bonded to the cover. The cover has an interior surface, the cover being bonded to the elongated piece of shape-retaining deformable material along the entire interior surface of the cover. The cover has a durometer of greater than 50 shore A and the outer cover has a durometer of less than 50 shore A. Optionally, the outer cover has ribs. Alternatively, the cover and outer cover are thermoplastic polymers. In one configuration, the outer cover is composed of a softer material than the cover. Optionally, the twist tie has a gripping surface. In one alternative, the gripping surface includes outwardly extending ribs. Optionally, the cover has a durometer of approximately 85 shore A and the outer cover has a durometer of approximately 15 shore A. Alternatively, the outer cover provides a high friction gripping surface for gripping objects or gripping the twist tie device when the device is twisted together.

In one embodiment, a method of holding an object includes providing a twist tie having a stretchable end with an aperture; and stretching the stretchable end around the object such that the object is in the aperture. Optionally, the method further includes wrapping a twist tie end of the twist tie around the object. In one alternative, the object is a cord, the stretchable end is placed around the cord, the cord is coiled, and then the cord is held by the wrapping. In another alternative, the aperture is a narrow slit in the stretchable end. Alternatively, the aperture may stretch wider and longer than a starting shape. Optionally, the stretchable end is made of TPE and has a durometer between 30 and 100 shore A. Alternatively, the stretchable end is overmolded on the twist tie.

DETAILED DESCRIPTION

Figure 1:
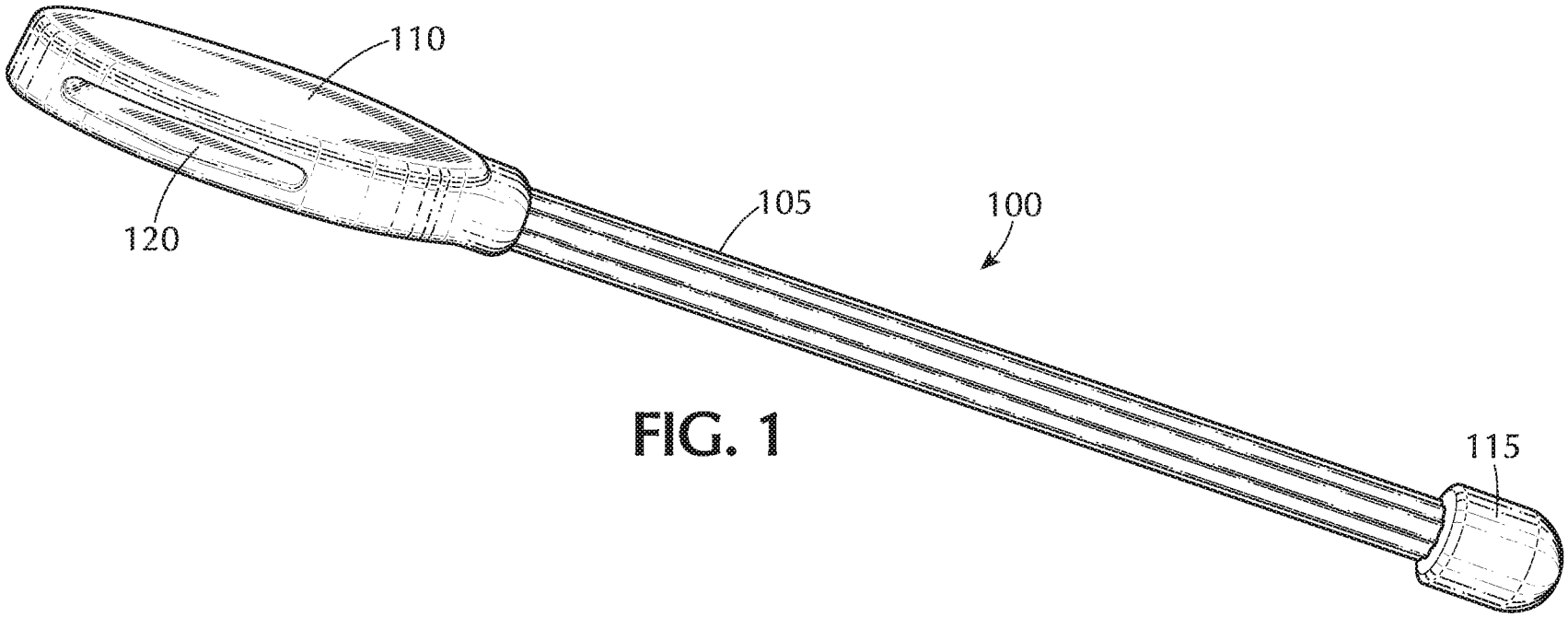
FIG. 1 shows one embodiment of a twist tie, specifically a twist tie with a stretchable end including an aperture.

Certain terminology is used herein for convenience only and is not to be taken as a limitation on the embodiments of a cord holder. In the drawings, the same reference letters are employed for designating the same elements throughout the several figures.

FIG. 1 shows one embodiment of a twist tie, specifically a twist tie with a stretchable end 100 including an aperture 120. Twist tie with a stretchable end 100 includes a twist tie portion 105 and a stretchable end 110. Stretchable end 110 includes an aperture 120. Any length twist tie portion alternatively may be used. At the end of the twist tie portion 105 is an end cap 115 which enhances the ability of the user to wrap and secure the twist tie 100. Twist tie with a stretchable end 100 is formed by molding stretchable end 110 around twist tie portion 105. Stretchable end 110 may be composed of a variety of materials including, but not limited to, plastics, rubbers, nylon, etc. In the embodiment shown, stretchable end 110 is composed of Thermoplastic Elastomer (TPE) having a 50 shore A durometer. In the embodiment shown, twist tie portion 105 is a Gear Tie™ twist tie, and it includes special proprieties improving its function. Gear Tie™ twist ties include a softer durometer outer plastic layer of having a durometer less than 50 shore A and having an inner plastic layer of a harder durometer of greater than 50 shore A. Furthermore, the inner layer is bonded to the wire, and the outer layer is bonded to the inner layer. The inner layer may be composed of high density polyethylene. An adherent may be used to bind the inner layer to the wire. In some alternatives of twist tie with a stretchable end 100, the twist tie portion has a softer outer layer of a durometer of less than 100 shore A. In some alternatives, this outer durometer is less than 50 shore A. In these embodiments with a softer outer plastic layer, the twist tie portion may be passed through the aperture 120. When the durometer is softer on the outer layer, this configuration may slightly compress the outer layer and result in a firmly held loop configuration. In this alternative and other related alternatives, the aperture of stretchable end 110 may be sized to accommodate twist tie portion 100. The aperture may be made slightly smaller than the diameter of twist tie 100. Furthermore, the aperture of stretchable end 110 may include protrusions or teeth that may add to the grip of twist tie 100 as it is passed through the aperture. In many embodiments, the twist tie portion 105 is formed first and the stretchable end 110 is overmolded on top of the twist tie portion 105.

Figure 2:
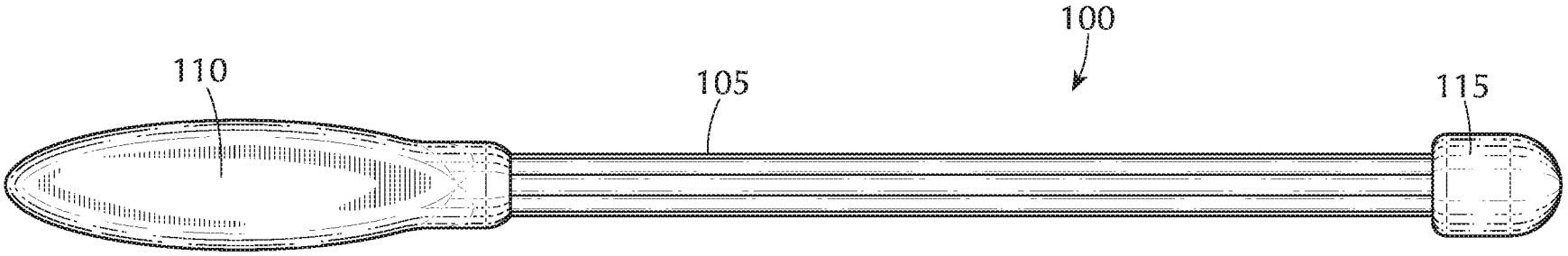
FIG. 2 shows a top view of the twist tie of FIG. 1.
Figure 3:
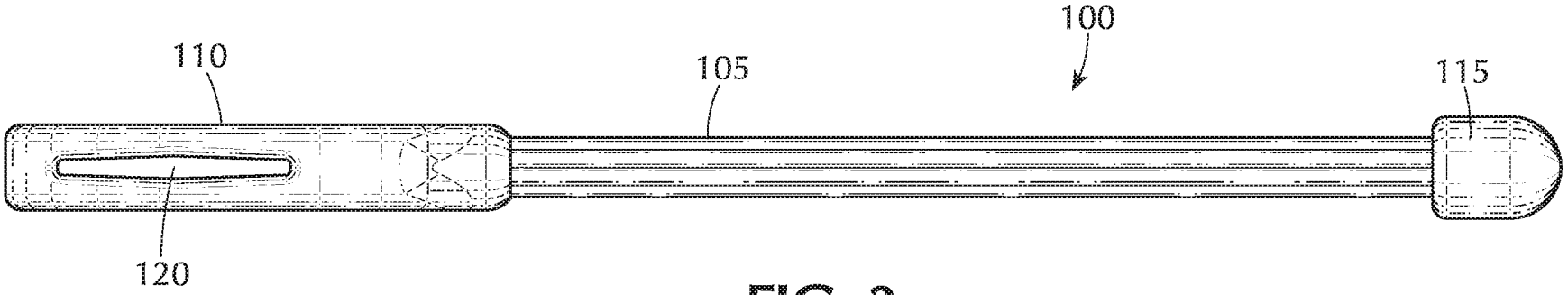
FIG. 3 shows a side view of the twist tie of FIG. 1.
Figure 5:
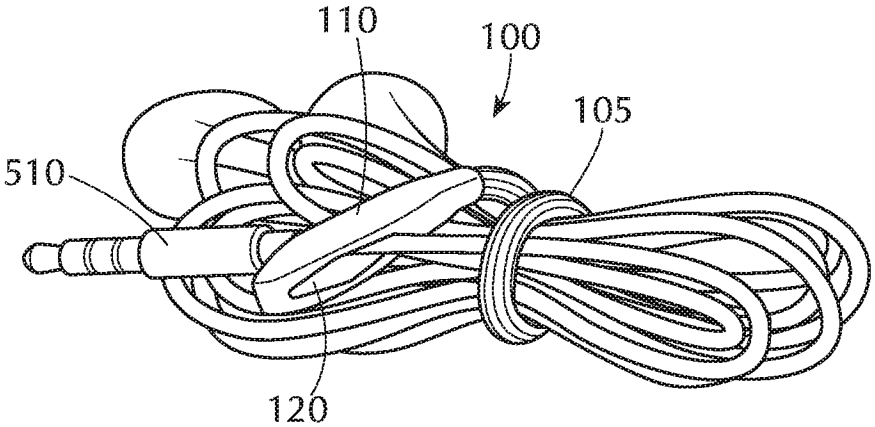
FIG. 5 shows the twist tie of FIG. 1 holding a headphone cord.
Figure 4:
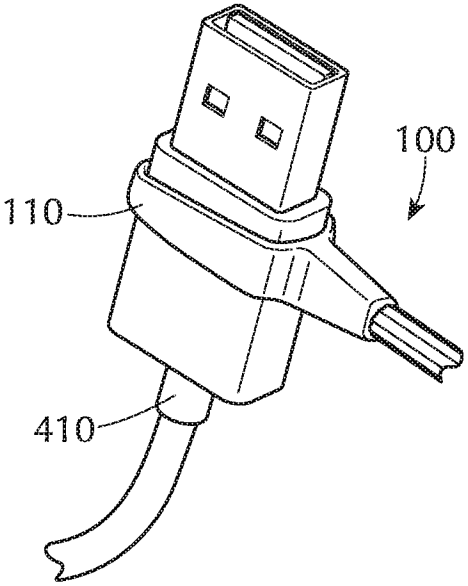
FIG. 4 shows the twist tie of FIG. 1 holding a USB cord in the stretchable end.

FIGS. 2 and 3 show additional views of the twist tie 100. As can be seen, the profiles of the stretchable end 110 are generally that of an oval from the top and bottom and generally rectangular from the side view. In alternatives, many other shapes are possible for both profiles. It is thought that a rectangular cross section for the side view with a narrow slit generally provides for enhanced holding characteristics with a minimum of material. Of note is that the outer layer of the twist tie portion 105 is composed of TPE having a 50 A shore durometer. Additionally, the stretchable end 110 is composed of TPE having a 50 A shore durometer. The twist tie portion 105 includes an inner wire that adds rigidity to the twist tie portion 105. Additionally, the bonded nature of the twist tie portion 105 increases the rigidity. In contrast, the stretchable end 110 does not include any rigidity features and, therefore, may stretch to fit around objects and hold them firmly. Some examples of this are seen in FIGS. 4 and 5. In FIG. 4, the stretchable end 110 stretches around a USB plug 410. Therefore, the twist tie 100 stays attached to the USB plug 410 in usage. When the USB plug 410 is no longer in use, the twist tie 100 that is attached to it by virtue of the stretchable end may then be used to wrap around and secure the cord.

FIG. 5 shows one example of such a usage. In the scenario shown in FIG. 5, a headphone cord 510 has been secured with a twist tie 100. The stretchable end 110 has been stretched to fit around and hold the headphone cord 510. Since the cord is not in use, the twist tie portion 105 has been wrapped around the coiled headphone cord 510. When the cord is unwrapped, the stretchable end 110 will stay attached to the headphone cord 510.

The dimensions of the stretchable end 110 and the aperture 120 enhance its operation. One teaching herein is that dimensions of the stretchable end 110 and the aperture 120 are designed to match the durometer of the material. Generally, in embodiments herein, the size and width of the aperture is designed to stretch to hold the expected objects. Therefore, the aperture length and width are proportional to the durometer of the material and the expected object. In the embodiments shown, the stretchable end is generally designed to hold small objects, such as cord ends. Therefore, the durometer of the material is set at approximately 50 shore A. The length of the aperture is generally in the range of 0.5 to 3 cm for this purpose. In the embodiment shown, the length is approximately 11.43 mm. The width of the aperture is approximately 1.12 mm, with embodiments for this purpose ranging from 0.5 to 5 mm. The overall width of the stretchable end is approximately 4.1 mm, with the range generally between 2 and 10 mm. The overall depth of the stretchable end is approximately 6.35 mm, with embodiments for this purpose falling in a range of 2 to 4 mm. Such dimensions considering the durometer of the material allows the stretchable end to stretch around objects and hold them firmly. For larger sized holders, in some embodiments, the durometer is increased as well as the proportional size of the dimensions of the stretchable end. In many embodiments, "stretchable end" means that the end may stretch ½, 2, 5, or 10 times its length and width or any multiple in between.

Figure 6:
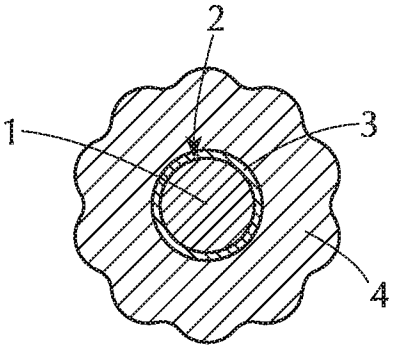
FIG. 6 shows a cross-section of the twist tie portion of the twist tie of FIG. 1.

FIG. 6 shows a cross-section of the twist tie portion. As noted above, the outer layer 4 is made out of TPE and typically has a durometer in the range of less than 100 shore A to at least 30 shore A. The inner layer 3 typically is composed of high density polyethylene having a durometer of 50 shore A or greater. An adhesive layer 2 may assist in the bonding of the inner layer 3 to the wire 1. The heated extrusion process may enhance the bonding nature of the layers.

While specific embodiments have been described in detail in the foregoing detailed description and illustrated in the accompanying drawings, it will be appreciated by those skilled in the art that various modifications and alternatives to those details could be developed in light of the overall teachings of the disclosure and the broad inventive concepts thereof. It is understood, therefore, that the scope of this disclosure is not limited to the particular examples and implementations disclosed herein but is intended to cover modifications within the spirit and scope thereof as defined by the appended claims and any and all equivalents thereof.

What is claimed as new and desired to be protected by Letters Patent of the United States is:

1. An apparatus for securing items, the apparatus comprising:

a twist tie; and a stretchable end for the twist tie, the stretchable end molded around the twist tie, the stretchable end comprising a round or oval profile from a first view, a rectangular profile from a second view, and an aperture defined through the rectangular profile of the stretchable end, wherein the aperture of the rectangular profile is a narrow slit in the stretchable end.

2. The apparatus of claim 1, wherein the aperture may stretch wider and longer than a starting shape.

3. The apparatus of claim 2, wherein the stretchable end is made of Thermoplastic Elastomer (TPE) and has a durometer between 30 and 100 shore A.

4. The apparatus of claim 3, wherein the stretchable end is overmolded on the twist tie.

5. The apparatus of claim 4, wherein the stretchable end is designed to hold an object, and the aperture of the stretchable end is sized such that, to hold the object, the stretchable end stretches and, therefore, frictionally holds the object.

6. The apparatus of claim 5, wherein the twist tie includes:

an elongated piece of shape-retaining deformable material;

a cover covering the shape-retaining deformable material along a length of the elongated piece, the cover and the shape-retaining deformable material being bonded along their length; and an outer cover covering the cover, the outer cover bonded to the cover, wherein the cover has an interior surface, the cover being bonded to the elongated piece of shape-retaining deformable material along the entire interior surface of the cover, wherein the cover has a durometer of greater than 50 shore A and the outer cover has a durometer of less than 50 shore A.

7. The apparatus of claim 6, wherein the outer cover has ribs.

8. The apparatus of claim 6, wherein the cover and outer cover are thermoplastic polymers.

9. The apparatus of claim 6, wherein the outer cover is composed of a softer material than the cover.

10. The apparatus of claim 1, wherein the twist tie has a gripping surface.

11. The apparatus of claim 10, wherein the gripping surface includes outwardly extending ribs.

12. The apparatus of claim 6, wherein the cover has a durometer of approximately 85 shore A and the outer cover has a durometer of approximately 15 shore A.

13. The apparatus of claim 6, wherein the outer cover provides a high friction gripping surface for gripping objects or gripping the twist tie when the twist tie is twisted together.

14. A method of holding an object, comprising:

providing a twist tie having a stretchable end with an aperture, the stretchable end overmolded on the twist tie and comprising a round or oval profile from a first view and a rectangular profile from a second view, the aperture defined through the rectangular profile of the stretchable end, wherein the aperture of the rectangular profile is a narrow slit in the stretchable end; and stretching the stretchable end around the object such that the object is in the aperture.

15. The method of claim 14, further comprising:

wrapping a twist tie end of the twist tie around the object.

16. The method of claim 14, wherein the object is a cord, the stretchable end is placed around the cord, the cord is coiled, and then the cord is held by the wrapping.

17. The method of claim 16, wherein the aperture may stretch wider and longer than a starting shape.

18. The method of claim 17, wherein the stretchable end is made of Thermoplastic Elastomer (TPE) and has a durometer between 30 and 100 shore A.

19. The apparatus of claim 1, wherein the stretchable end comprises top and bottom sides extending parallel to the narrow slit in an unstretched configuration.

20. The apparatus of claim 1, wherein the stretchable end does not include rigidity features, such that the stretchable end stretches to fit around objects to hold them firmly.

* * * * *